United States Patent [19]

Schneider

[11] 4,008,542

[45] Feb. 22, 1977

[54] SOUNDING TRUNDLE AND HOOP

[75] Inventor: Chris J. Schneider, McAllen, Tex.

[73] Assignee: The Raymond Lee Organization, Inc., New York, N.Y. ; a part interest

[22] Filed: Dec. 29, 1975

[21] Appl. No.: 644,552

[52] U.S. Cl. ..... 46/220

[51] Int. Cl.[2] ..... A63H 33/02

[58] Field of Search ..... 46/112, 114, 205, 220

[56] References Cited

UNITED STATES PATENTS

| | | | |
|---|---|---|---|
| 1,302,389 | 4/1919 | Lemons | 46/114 |
| 1,490,503 | 4/1924 | Bergstrom | 46/114 |
| 2,767,515 | 10/1956 | Baker | 46/114 |
| 3,001,324 | 9/1961 | Walker | 46/220 |
| 3,918,708 | 11/1975 | Augusta | 46/220 |

*Primary Examiner*—G.E. McNeill
*Assistant Examiner*—Robert F. Cutting
*Attorney, Agent, or Firm*—Howard I. Podell

[57] ABSTRACT

A spoked wheel and a push-pull rod designed to be employed for rolling the wheel or stopping the wheel when it is in motion. The push-pull rod is shaped at one end with a U-shaped bracket of a width to fit about the rim of the wheel, with a flexible detent member located on the inner face of each parallel arm of the U-shaped bracket and of a length to be engaged by a spoke of the wheel when the bracket end of the push-pull rod is pushed over the wheel rim, for purposes of rotating or braking the wheel.

1 Claim, 6 Drawing Figures

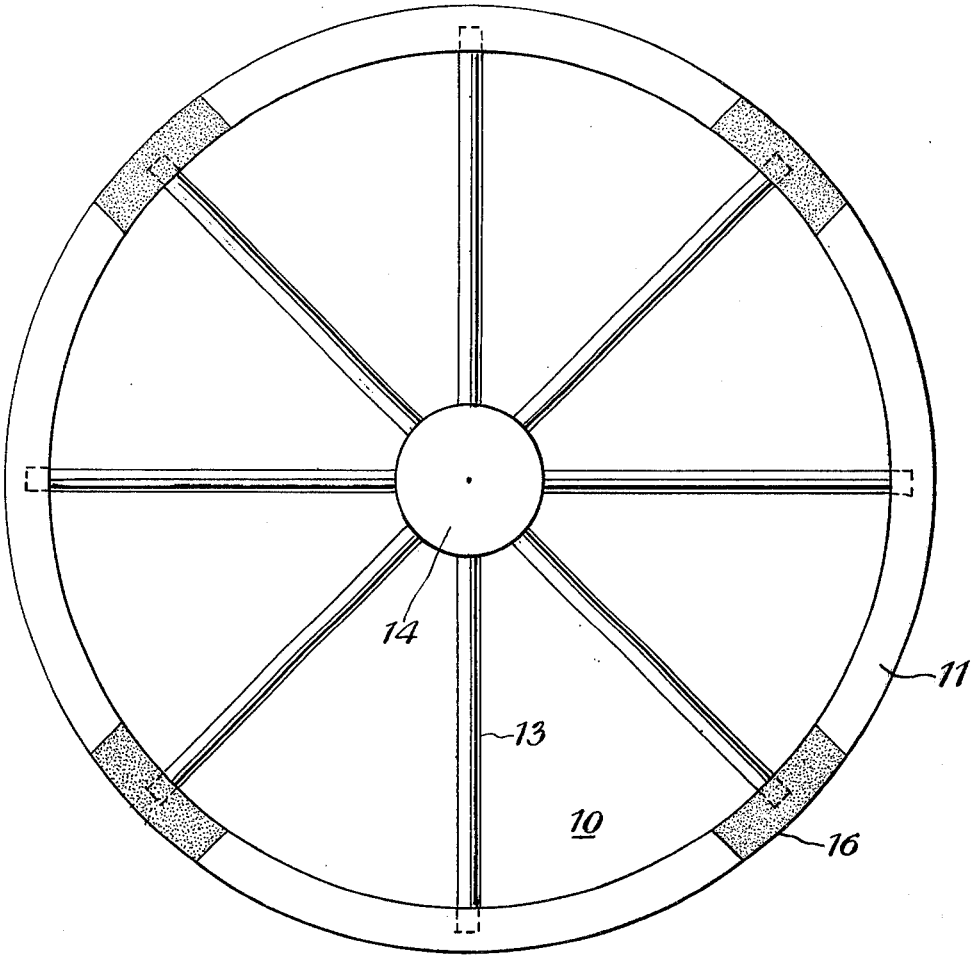
FIG. 1
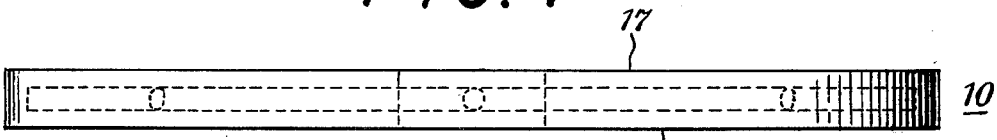
FIG. 2
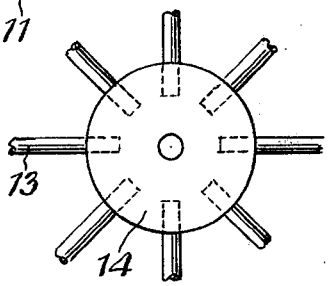
FIG. 3
FIG. 4
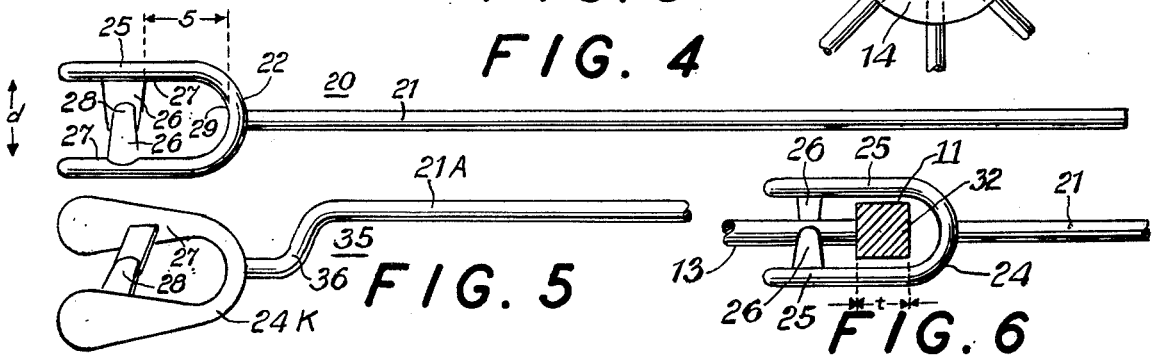
FIG. 5
FIG. 6

SOUNDING TRUNDLE AND HOOP

SUMMARY OF THE INVENTION

My invention is a spoked wheel and a push-pull rod designed to be employed for rolling the wheel or stopping the wheel when it is in motion. The push-pull rod is shaped at one end with a U-shaped bracket of a width to fit about the rim of the wheel, with a flexible detent member located on the inner face of each parallel arm of the U-shaped bracket and of a length to be engaged by a spoke of the wheel when the bracket end of the push-pull rod is pushed over the wheel rim, for purposes of rotating or braking the wheel.

BRIEF DESCRIPTION OF THE DRAWINGS

The objects and features of the invention may be understood with reference to the following detailed description of an illustrative embodiment of the invention, taken together with the accompanying drawings in which:

FIG. 1 is an elevation view of the wheel of the invention;

FIG. 2 is a plan view of the wheel of the invention;

FIG. 3 is a fragmentary elevation view of the wheel hub;

FIG. 4 is an elevation view of the push-pull rod;

FIG. 5 is a perspective view of an alternate embodiment of the push rod; and FIG. 6 is a fragmentary sectional view of the push rod engaged with a wheel spoke.

DESCRIPTION OF THE PREFERRED EMBODIMENT:

Turning now descriptively to the drawings, in which similar reference characters denote similar elements throughout the several views, FIGS. 1–3 illustrate the wheel 10 of the invention which is formed of a circular rim 11 of generally rectangular cross-section, joined by a plurality of cylindrical spokes 13 to a solid wheel hub 14. Patches 16 of light reflecting tape are mounted to the sides 17 of the wheel rim 11.

The push-pull rod 20 as shown in FIGS. 4 and 6, is formed of a straight shaft 21 joined at one end to the back 22 of the mid-section 23 of a U-shaped bracket 24, the legs 25 of which are generally parallel to each other, pointed away from the shaft 21. A flexible detent 26 is mounted to the inside surface 27 of each leg 25, with the detents 26 each of a length greater than half the distance d separating legs 25, with each detent 26 offset and oriented so as to overlap the free end 28 of the other.

The detents 26 are each mounted at a distance s from the inside face 29 of the mid-section 23 of the bracket 24, which distance s is greater than the thickness t of the wheel rim 11 so that the detents 26 may be inserted over the wheel rim 11 to engage a spoke 13 of the wheel 10 as shown in FIG. 6, for the purpose of either rotating wheel 10, or braking wheel 10 when rotating to a stop, while making a pleasing sound as the detents 26 flip past momentarily engaged spokes.

The overlapping configuration of detents 26 permits engagement of a single wheel spoke 13 of a standing wheel to permit reciprocal momentary rotation of the wheel by alternately manually pushing and pulling on shaft 21 employing a first level of tension or compression force insufficient to free detents 26 engaging both sides of a spoke 13 as shown in FIG. 6. A higher level of force applied to shaft 21 causes the detents 26 to flex past the formerly engaged spoke 13 to cause the wheel to rotate freely until the next spoke 13 hits the detents 26.

The user may, by use, achieve sufficient skill to cause the wheel to rotate by a specific angle striking a desired number of spokes 13 against the detents 26.

Alternately, push-pull rod 21 may be manipulated so that detents 26 rest against the exterior surface 32 of rim 11 for the purpose of causing the wheel 10 to roll in a continuous motion.

FIG. 5 illustrates an alternate embodiment of the push-pull rod 35 in which U-shaped bracket 24A is mounted in an off-set position to the axis of shaft 21A by an S-curved section 36 at an end of shaft 21A, with bracket legs 25 set parallel to each other at a distance from the axis of shaft 21A. Legs 25 may be in the plane of S-section 36 or in a plane at an angle to S-section 36.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A toy comprising a spoked wheel and a push-pull rod that may be employed to rotate the wheel in a reciprocal motion, said wheel being formed with a rim joined to a hub by a plurality of spokes, said push-pull rod formed of a shaft fixed at one end to a U-shaped bracket of a size to fit about the wheel rim, said U-shaped bracket formed of a mid-section joined to a pair of spaced legs generally parallel to each other and to the shaft and extending away from said shaft, with a flexible detent mounted to the inside of each leg of the bracket, each said detent located at a distance from the said bracket mid-section that is greater than the thickness of the rim of the said wheel so as to be in a position to engage a spoke of the said wheel when the bracket is fitted about the said rim, with each detent extending from the attached leg by a distance greater than one-half the spacing between said lege, with the axes of said detents off-set from each other so that one detent overlaps the other detent, such that the wheel may be manipulated to roll or to stop rolling by manual use of the shaft with the bracket inserted about the wheel rim and with the detents momentarily engaged to the spokes of the wheel, as desired.

* * * * *